US005926856A

United States Patent [19]

Duval

[11] Patent Number: 5,926,856

[45] Date of Patent: Jul. 27, 1999

[54] PAIR OF PROTECTIVE PANTS

[75] Inventor: Helene Duval, Montreal, Canada

[73] Assignee: Sport Maska Inc., Quebec, Canada

[21] Appl. No.: 08/879,391

[22] Filed: Jun. 20, 1997

Related U.S. Application Data

[60] Provisional application No. 60/020,038, Jun. 21, 1996.

[51] Int. Cl.[6] ..... A41D 13/00

[52] U.S. Cl. ..... 2/455; 2/466; 2/467; 2/22

[58] Field of Search ..... 2/455, 464, 466, 2/467, 456, 22, 23

[56] References Cited

U.S. PATENT DOCUMENTS

| | | | |
|---|---|---|---|
| 1,857,850 | 5/1932 | Jones | 2/23 |
| 1,915,754 | 6/1933 | O'Shea | 2/467 |
| 3,170,163 | 2/1965 | Mitchell | 2/466 |
| 3,484,868 | 12/1969 | Davenport, Jr. | 2/467 |
| 4,325,148 | 4/1982 | Livernois | 2/467 |
| 4,577,346 | 3/1986 | Hall | 2/466 |

*Primary Examiner*—Michael A. Neas
*Attorney, Agent, or Firm*—Factor and Shaftal. LLC

[57] ABSTRACT

A protective pant for use in a contact sport comprises an outer shell, a back padded region, an upper padded member, right and left leg padded members and a check pad. The outer shell includes an upper region, a left leg region and a right leg region. The upper region includes a front side, a right side, a left side and a rear side. The back padded region is associated with the rear side of the upper region and includes multiple back padded members positioned in a substantially vertical orientation. The upper padded member is slidably movable and overlayingly positioned relative to the right and left leg padded members. The check pad is operably associated with the outer shell.

13 Claims, 4 Drawing Sheets

PAIR OF PROTECTIVE PANTS

Applicant claims priority based on Provisional Patent Application Ser. No. 60/020,038 filed Jun. 21, 1996.

THE FIELD OF THE INVENTION

The invention relates in general to protective pants and, more specifically to protective pants, for use in playing contact sports, such as hockey.

BACKGROUND OF THE INVENTION

Protective pants have been known and used for decades. Specifically, they have been developed to primarily protect an individual's midsection, the area between the individual's knees and chest, during participation in contact sports, such as hockey. Such protective pants have been constructed in both a single integrated pant version and two, or more, piece versions having at least an inner girdle and outer pant shell. As technology has improved, so has the design of such protective pants. However, these prior protective pants have had some deficiencies due to their construction.

Because of the greatly increased size, strength and speed of the wearers of these types of protective pants, the recent design emphasis of such protective equipment have focused not only on the quality and quantity of protection, but also on flexibility and fit. Prior art protective pants, while perhaps providing an adequate level of protection to the wearer, often times, are generally not ergonomically friendly and generally do not provide the wearer a proper fit that provides adequate flexibility.

For example, prior art protective pants often restrict the movement of the wearer, such as, for example, a hockey player taking a stride. Alternatively, non-restricting prior art protective pants did not substantially restrict the movement of the wearer, but, often would expose and leave unprotected a portion of the wearer's body that should have been protected. For example, a wearer of such prior art pants bending at the waist would often expose his/her back or sides to injury.

With respect to hockey, it is quite common for a hockey player to be "checked" into the "boards" exposing his/her hips to substantial impact. While prior protective pants may afford some protection to the hip area, they were not specifically designed to provide maximum protection against such an impact, nor were the pants otherwise ergonomically efficient.

In summary, prior art protective pants were, for the most part, unable to provide adequate protection to the wearer or provide the desired flexibility of movement of the wearer.

SUMMARY OF THE INVENTION

The invention comprises a protective pant that includes an outer shell, a back padded region, at least one upper padded member, at least one left and right leg padded member, and a check pad. The outer shell includes an upper region, a left leg region and a right leg region. The upper region includes a front side, a right side, a left side and a rear side. The back padded region is associated with the rear side of the upper region. The back padded region includes at least two separate back padded members. The back padded members are positioned in a substantially vertical orientation, and protect a user, while ergonomically flexing and following a body contour of a user.

The at least one upper padded member is operably associated with the upper region of the outer shell. Additionally, the upper padded member extends around at least a portion of at least two of the front side, the right side, the left side and the rear side of the outer shell. The right leg padded member is operably associated with the right leg region of the outer shell. The left leg padded member is operably associated with the left leg region of the outer shell. The upper padded region overlays and is slidably positionable relative to at least a portion of the left and right leg padded members. This overlapping orientation facilitates relative movement between the upper padded member and the right and left leg padded members while maintaining a substantially continuous padding about a user. The check pad extends about at least a portion of the front side and at least one of the right and left side of the upper region of the outer shell. The pad tapers as it extends from the front side away toward the left and right sides of the upper region of the outer shell.

In a preferred embodiment, the back padded region comprises at least three separated padded members positioned in a substantially vertical orientation, proximate the lower spinal region of a user. In such an embodiment, the padded regions are separated by a vertical seam. The padded members additionally comprise at least one rigid layer and at least one resilient layer.

In another preferred embodiment, the length of the upper padded member is smaller than the length of at least one of the left and right leg padded members. Further, the upper padded member may comprise a left pad associated with the left side of the upper region of the outer shell, a right pad associated with the right side of the upper region of the outer shell and a rear pad associated with the rear side of the upper region of the outer shell.

In a preferred embodiment, the right leg padded member and the left leg padded member may each comprise three separate pads that encircle at least a portion of the respective leg portion of the outer shell. In another preferred embodiment, one of the three separate pads on each leg may comprise a pad that is hingedly attached to the outer shell about a side edge. Thus, the pad is permitted to hingedly rotate about the side edge.

In yet another preferred embodiment, the upper padded member is releasably attachable to one of the outer and the inner surface of the outer shell. Further, an elastic region may be associated with the right and left leg regions of the outer shell, to facilitate a proper fit among varying sized users. Additionally, an elastic crotch panel may extend about at least a portion of the front side and the rear side of the upper region, between the right and left leg regions.

In a preferred embodiment, the check pad may be hinged about a lower edge, to, in turn, permit hinged rotation about the lower edge. The check pad may further include means for adjusting the check pad about the waist of the user.

In another preferred embodiment, the outer shell may include an elastic member which operably abuts the check pad. This elastic member facilitates movement of the check pad relative to the upper region of the outer shell.

BRIEF DESCRIPTION OF THE DRAWINGS

For a better understanding of the present invention, reference may be had to the accompanying drawings in which.

DETAILED DESCRIPTION OF THE DRAWINGS

Figure 2:
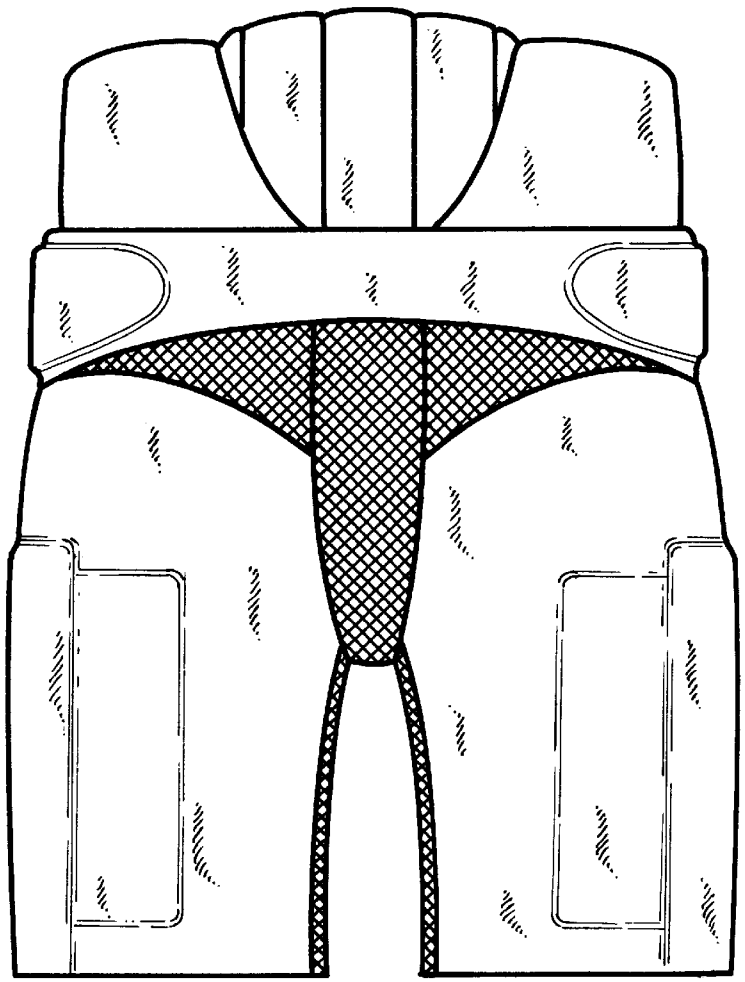
FIG. 2 of the drawings is a back elevational view of the protective pant.

While this invention is susceptible of embodiment in many different forms, there is shown in the drawings and will herein be described in detail, one specific embodiment with the understanding that the present disclosure can be considered as an exemplification of the principles of the invention and is not intended to limit the invention to the embodiment illustrated.

Figure 1:
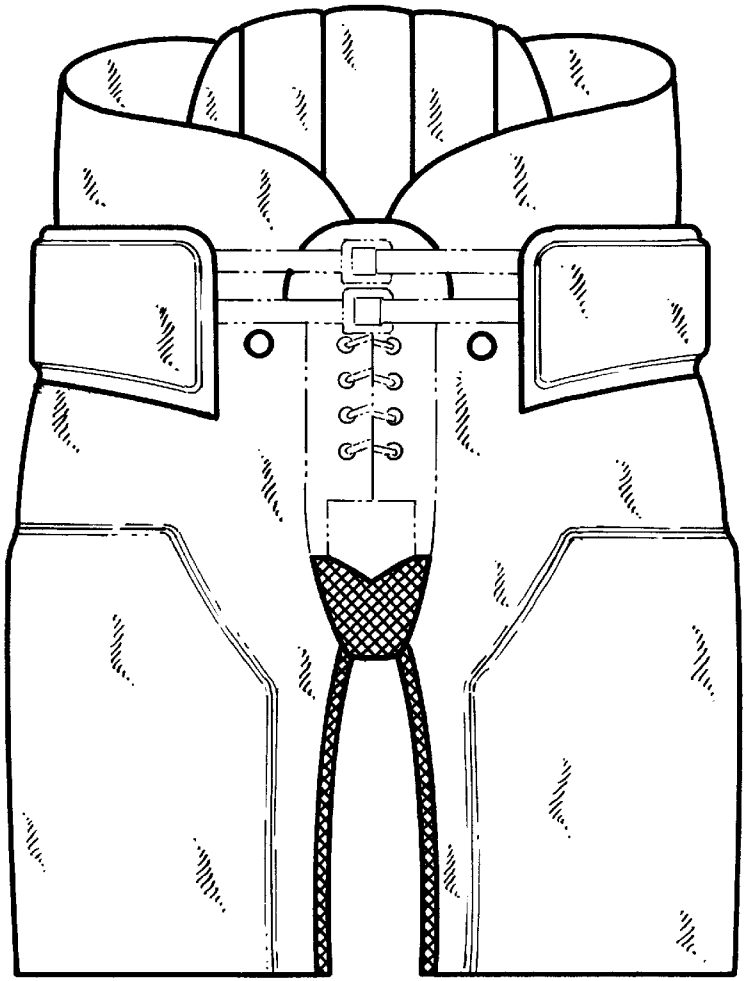
FIG. 1 of the drawings is a front elevational view of a protective pant of the present invention.
Figure 6:
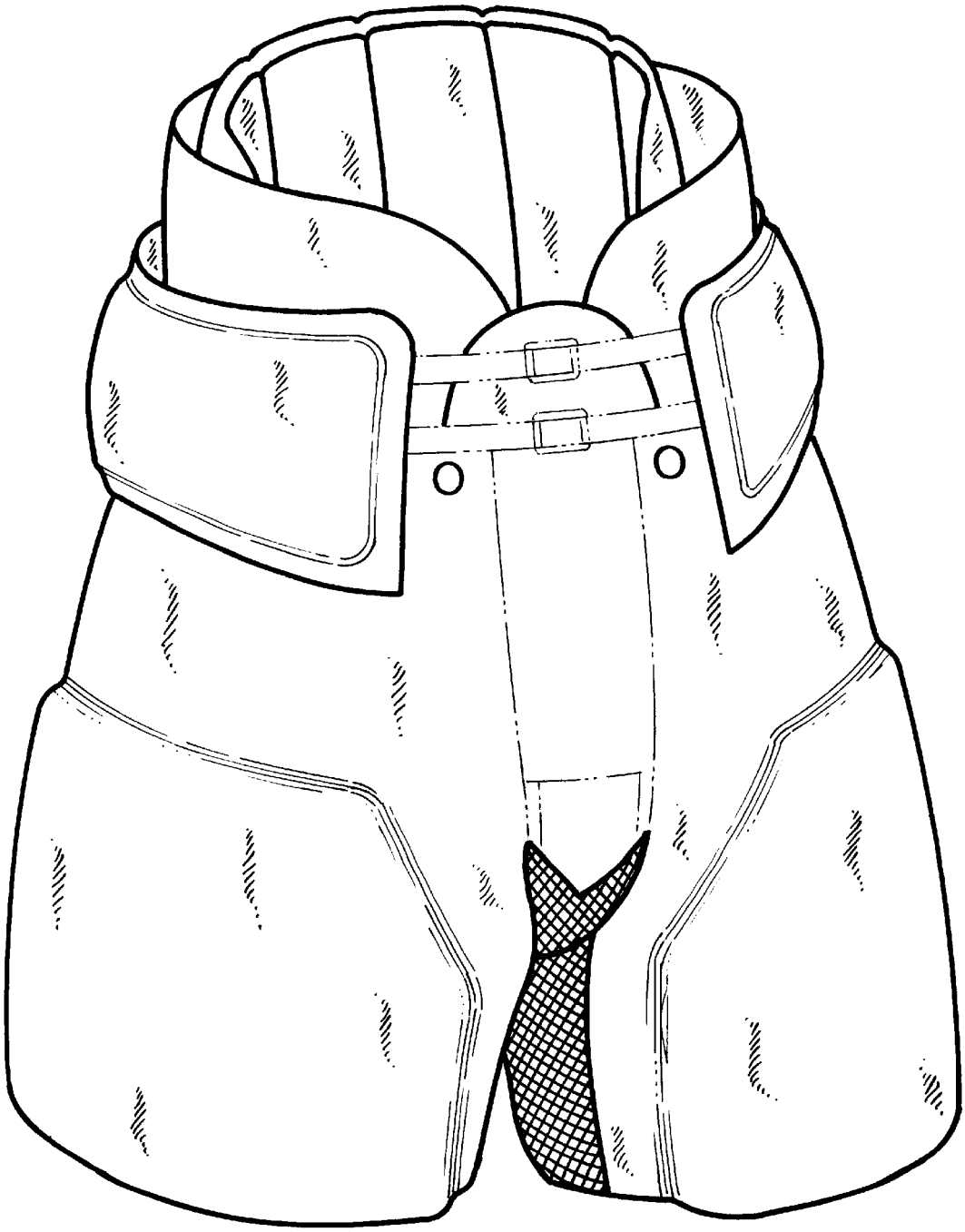
FIG. 6 of the drawings is a perspective view of the protective pant.

Protective pant 10 is shown in FIGS. 1–2, 6 as comprising outer shell 12, back padded region 14, upper padded member 16, right and left padded members 18, 20, respectively, and check pad 22. While other uses are contemplated, protective pant is contemplated for use in association with the playing of a contact sport, such as hockey.

Outer shell 12 is shown in FIGS. 1–2, 6 as comprising attachment member 19, upper region 26, left leg region 28 and right leg region 30. Attachment member 19 includes belt 21 and lacing 25 which snugly maintains the pant on the user. Upper region 26 includes elastic regions 23, front side 38, left side 40, right side 42 and rear side 44. While outer shell 12 is generally constructed from a single or multi layer nylon knit material that is resistant to rips and cuts, other synthetic and natural materials are likewise contemplated.

Figure 5:
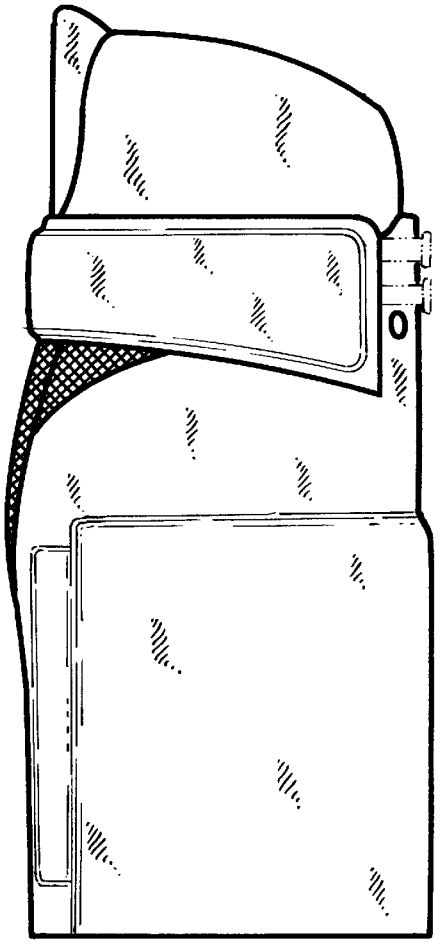
FIG. 5 of the drawings is a right side view of the protective pant.
Figure 3:
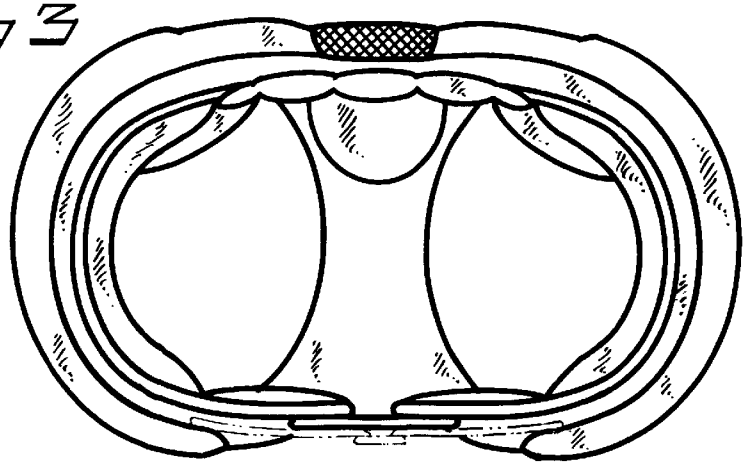
FIG. 3 of the drawings is a top plan view of the protective pant.
Figure 4:
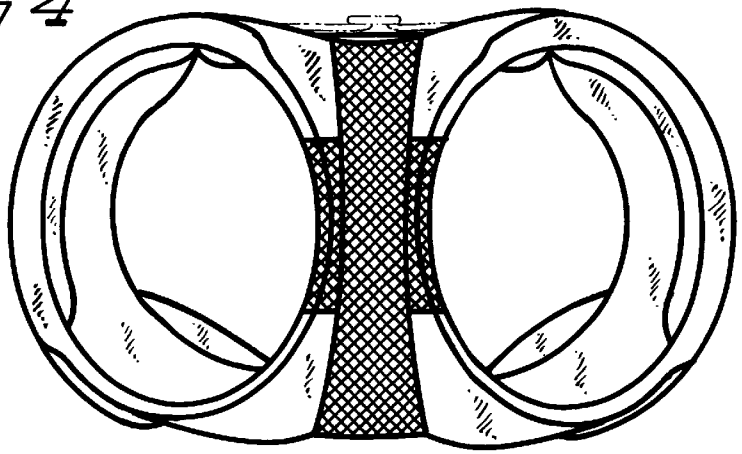
FIG. 4 of the drawings is a bottom plan view of the protective pant.

Elastic regions 23, as shown in FIGS. 3–5, further include first elastic region 24 and second elastic region 36. First elastic region 24 is positioned proximate the crotch region. Second elastic region 36 is positioned proximate the upper region of the pants. These regions further facilitate the stretching and flexibility to, in turn, render a better fit to the user.

As shown in FIG. 1 and 2, left leg region 28 abuts upper region 26 and serves to cover a portion of the lef thigh of a user. Similarly, right leg region 30 abuts upper region 26 and covers a portion of the right thigh of a user. Each of left leg region 28 and right leg region 30 include elastic regions 27, 27' (FIG. 4), respectively, which facilitate a better fit on a wide range of differently sized users.

Upper padded member 16 is shown in FIGS. 1, 2, 3 and 5 as comprising left pad 46 (FIG. 3), right pad 48 (FIG. 3), rear pad 50 (FIG. 3), upper hip pad 51 and accepting region 47. Left pad 46 extends from front side 38, around left side 40, to rear side 44. Similarly, right pad 48 extends from front side 38, around right side 42, to rear side 44. Rear pad 50 is shown in FIG. 3 as including three elongated vertically oriented pads 53, 53', 53" which are positioned between the right pad and the left pad. Hip pad 51 (FIG. 1 and 2) extends about virtually the entirety of the upper torso and surrounds accepting region 47. As will be explained, accepting region 47 facilitates receipt of back padded region 14.

While left and right pads are each shown as a single continuous pad member, it is likewise contemplated that these pads may comprise any number of smaller pads which can be joined together. Likewise, the left and right pads, rear pad 50 and hip pad 51 may comprise a single molded pad or any number of smaller pads. Further, left pad 46, right pad 48, rear pad 50 and hip pad 51 may each comprise two layers of padding material. For instance, they may include a rigid layer and a cushioned layer. The rigid layer and cushion layer together facilitate proper and complete absorption of an impact. Additionally, the pads may include a water resistant coating which keeps the pads from absorbing body perspiration and water from, for instance, the ice surface. Of course, various other materials are likewise contemplated.

Moreover, upper padded member 16 may be fixedly attached to outer shell 12. Alternatively, upper padded member 16 or any component thereof may be releasably attached to outer shell through various means, including hook and loop fasteners, snaps, buttons and the like. As such, the user can separate the upper padded member or any components thereof from the outer shell, to, for example, launder only one component, or, to replace only one component of the protective pant.

Back padded region 14 is shown in FIGS. 1, 2 and 6 as comprising substantially vertical panels such as vertical panel 57. These panels are separated from each other by substantially vertical seams such as seams 34. Back padded region 14 fits into accepting region 47 of the upper padded member. Alternatively, it may be fixedly or releasably attached directly to the outer shell. Due to the construction, each vertical panel is permitted to pivot about seams 34. This pivoting facilitates the pad to follow the contours of the user's body as the user plays and moves. As with the other pads, each vertical panel 57 comprises a pad having one rigid layer 98 and one resilient layer 99.

Right leg padded member 18 and left leg padded member 20 are shown in FIGS. 1 and 2 as being positioned in association with the respective leg regions of outer shell 12. Right leg padded member 18 includes encasing pad 60, rear pad 61 and front pad 62. Encasing pad 60 and rear pad 61 are permanently attached to the outer shell. Front pad 60 includes edge 65, which is hingedly attached to outer shell 12. As such, pad 62 is permitted to hingedly rotate about edge 65, to better follow and adjust to the user's movement. Of course, it is also contemplated that any of the pads may be fixedly or releasably attached to the inside or the outside of the outer shell, or between layers in a multi-layer outer shell. Additionally, as explained above with respect to other pads, these pads may comprise a multitude of material compositions.

Similarly, left leg padded member 20 includes encasing pad 70, back pad 71 and front pad 72. These pads are configured about left leg region of outer shell in a manner substantially identical to right leg padded member, as explained above.

Figure 7:
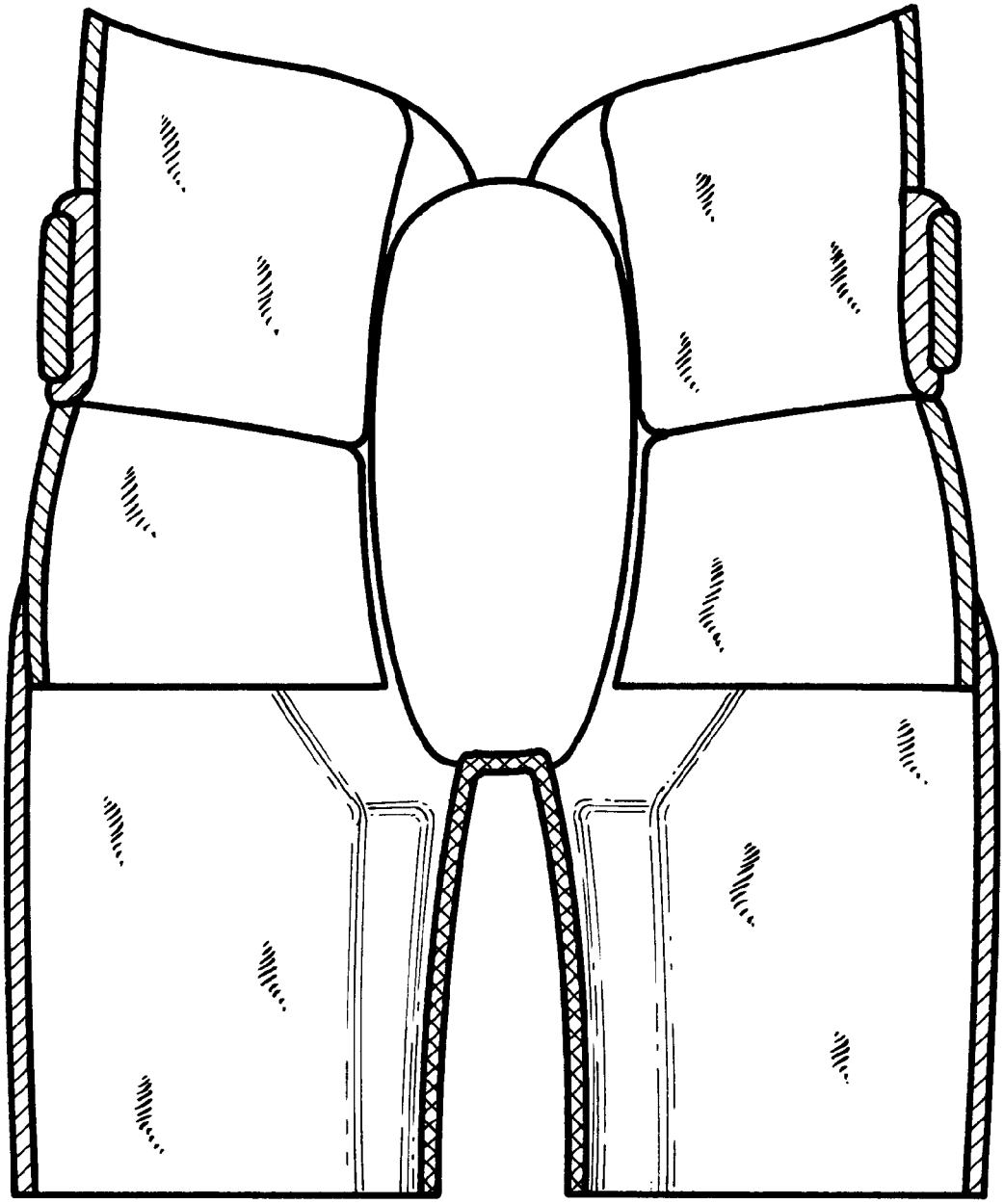
FIG. 7 of the drawings is a cross-sectional view of the protective pant taken generally about line 7—7 of FIG. 3.

As shown in FIG. 7, a portion of upper padded member 16 overlies a portion of each of right leg padded member 18 and left leg padded member 20. As a user moves and alters the relative orientation of his body, the upper padded member can slide relative to right padded member 18 and left padded member 20. Even at an extreme flexing by the user, due to the configuration, at least a portion of upper padded member 16 nevertheless overlies at least a portion of the right and left padded members 18, 20. Accordingly, a continuous padded surface is provided to the user. Thus, the overlaying structure of the padding permits maximum flexibility without sacrificing or compromising the level of protection afforded to the user.

Also as shown in FIG. 7, right leg padded member 18 and left leg padded member 20 are proportionally longer than left pad 46 and right pad 48. Indeed, by having the leg pads longer than the upper pads, the structure facilitates greater flexibility of the pant, and greater leg movement by the user.

Check pad 22 is shown in FIGS. 1, 2, 3 and 5 as including first edge 81, second edge 82, top edge 83, bottom edge 84 and adjusting means 88. Check pad 22 extends from first edge 81, proximate one side of lacing 25 to second edge 82, proximate the other side of lacing 25. Bottom edge 84 of check pad 22 is attached to outer shell 12 so that it may hingedly rotate relative to the outer shell about the lower edge. This single attachment structure permits greater movement and flexibility of the outer shell relative to the pad. The height of check pad 22 tapers in a direction extending away from the first and second edges, in either direction. Moreover the thickness of the check pad varies; the check pad is thickest proximate the hip region and thinnest in the back. The difference in height and thickness serves to save weight while nevertheless providing the proper protection where it is required.

Adjustment means 88 of check pad 22 is shown in FIG. 1 as comprising clasps 90, 90' and belt 91. Adjustment means 88 permits the user to have a custom fit of the check pad about the user's hips. Specifically, the user tightens or loosens belt 91 through adjustment at clasps 90, 90' until the proper desired fit the check pad is achieved.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

I claim:

1. A protective pant comprising:

an outer shell having an upper region, a left leg region and a right leg region;

the upper region including a front side, a right side, a left side and a rear side; and a back padded region associated with a rear side of the upper region, including at least two separate back padded members, each padded member having a height and a width, wherein the height is greater than its width, the two separate back padded members positioned in a substantially side by side orientation, to in turn, protect a back of a user while ergonomically flexing and following a body contour of a user.

2. The protective pant according to claim 1 wherein:

the back padded region comprises at least three separated padded members positioned in a substantially side-by-side orientation, proximate a lower spinal region of a user.

3. The protective pant according to claim 1 wherein the separate back padded regions are separated by a substantially vertical seam.

4. The protective pant according to claim 1 wherein the at least two padded members each include at least one rigid layer and at least one resilient layer.

5. A protective pant comprising:

an outer shell having an upper region, a left leg region and a right leg region the upper region including a front side, a right side, a left side and a rear side;

at least one upper padded member operably associated with the upper region of the outer shell, and extending around at least a portion of at least two of the front side, the right side, the left side and the rear side of the upper region of the outer shell;

at least one right leg padded member operably associated with the right leg region of the outer shell;

at least one left leg padded member operably associated with the left leg region of the outer shell;

the at least one upper padded member overlaying and slidably positionable relative to at least a portion of at least one of the at least one right leg padded member and the at least one left leg padded member, so as to facilitate relative movement between the at least one upper padded member and the right and left leg padded members while maintaining substantially continuous padding about a user; and the right leg padded member comprises three separate leg pads that encircle at least a portion of the right leg region of the outer shell.

6. The protective pant according to claim 5 wherein at least one of the three separate right pads is operably attached to the outer shell about a side edge, to, in turn, permit hinged rotation of the at least one of the three separate right pads about the side edge.

7. A protective pant comprising:

an outer shell having an upper region, a left leg region and a right leg region the upper region including a front side, a right side, a left side and a rear side;

at least one upper padded member operably associated with the upper region of the outer shell, and extending around at least a portion of at least two of the front side, the right side, the left side and the rear side of the upper region of the outer shell;

at least one right leg padded member operably associated with the right leg region of the outer shell;

at least one left leg padded member operably associated with the left leg region of the outer shell;

the at least one upper padded member overlaying and slidably positionable relative to at least a portion of at least one of the at least one right leg padded member and the at least one left leg padded member, so as to facilitate relative movement between the at least one upper padded member and the right and left leg padded members while maintaining substantially continuous padding about a user; and the left leg padded member comprises three separate leg pads that encircle at least a portion of the left leg of the outer shell.

8. The protective pant according to claim 7 wherein at least one of the three separate left pads is operably attached to the outer shell about a side edge, to, in turn, permit hinged rotation about the side edge.

9. A protective pant comprising:

an outer shell having an upper region, a left leg region and a right leg region;

the upper region including a front side, a right side, a left side, a rear side and a circumference;

an upper padded member operably associated with the upper region of the outer shell, and extending around at least a portion of at least two of the front side, the right side, the left side and the rear side of the upper region; and a check pad extending about at least a portion of the front side and at least a portion of at least one of the right and the left side of the upper region of the outer shell, proximate a waist region of a user, at least a portion of the upper padded member extending below and above the check pad the check pad tapering as it extends from the front side away toward the at least one of the left and right sides of the upper region of the outer shell.

10. The protective pant according to claim 9 wherein the check pad is attached to the outer shell about a lower edge to, in turn, permit hinged rotation about the lower edge.

11. The protective pant according to claim 9 wherein the check pad includes means for adjusting the check pad about the waist of a user.

12. The protective pant according to claim 9 wherein the outer shell includes an elastic region, the check pad being attached about a lower edge to the elastic region.

13. The protective pant comprising:

an outer shell having an upper region, a left leg region and a right leg region;

the upper region including a front side, a right side, a left side and a rear side;

a back padded region associated with the rear side of the upper region, including at least two separate back padded members, each padded member having a height and a width, wherein the height is greater than its width, the two separate back padded members positioned in a substantially horizontal side by side orientation, to in turn, protect a back of a user while ergonomically flexing and following a body contour of a user;

at least one upper padded member operably associated with the upper region of the outer shell, and extending around at least a portion of at least two of the front side, the right side, the left side and the rear side of the upper region of the outer shell;

at least one right leg padded member operably associated with the right leg region of the outer shell;

at least one left leg padded member operably associated with the left leg region of the outer shell;

the at least one upper padded member overlaying at least a portion of at least one of the at least one right leg padded member and the at least one left leg padded member throughout the entire range of motion of a user, and slidably positionable relative to at least a portion of at least one of the at least one right leg padded member and the at least one left leg padded member, so as to facilitate relative slidable movement between the at least one upper padded member and the right and left leg padded members while maintaining substantially continuous padding about a user.

a check pad extending about at least a portion of the front side and at least a portion of at least one of the right and the left side of the upper region of the outer shell, proximate a waist region of a user, at least a portion of the upper padded member extending below and above the check pad, the check pad tapering as it extends from the front side away toward the at least one of the left and right sides of the upper region of the outer shell.

* * * * *